United States Patent [19]

Sbabo

[11] 4,142,559

[45] Mar. 6, 1979

[54] DEVICE FOR PROVIDING SINGLE OR DOUBLE SELVEDGES FOR LOOMS

[76] Inventor: Silvio Sbabo, Via Romana Rompato, 6, Schio, (Vicenza), Italy

[21] Appl. No.: 816,779

[22] Filed: Jul. 18, 1977

[30] Foreign Application Priority Data

Jul. 30, 1976 [IT] Italy ..... 41635 A/76

[51] Int. Cl.[2] ..... D03D 47/48

[52] U.S. Cl. ..... 139/434; 139/302

[58] Field of Search ..... 139/54, 302, 194, 434, 139/429

[56] References Cited

U.S. PATENT DOCUMENTS

| | | | |
|---|---|---|---|
| 3,111,966 | 11/1963 | Demuth | 139/434 |
| 3,402,744 | 9/1968 | Scherillo | 139/54 |
| 3,563,280 | 2/1971 | Cugini | 139/434 |
| 3,951,177 | 4/1976 | Santucci | 139/434 |

*Primary Examiner*—Henry S. Jaudon

*Attorney, Agent, or Firm*—Guido Modiano; Albert Josif

[57] ABSTRACT

A device for providing single and double selvedges comprises a cutting unit, a retaining shoe for each selvedge, a pick up hook for each shoe adapted to bring the cut yarn back through the weft shed and cam actuators and linkages controlling the yarn cutting and picking up operations.

5 Claims, 9 Drawing Figures

DEVICE FOR PROVIDING SINGLE OR DOUBLE SELVEDGES FOR LOOMS

BACKGROUND OF THE INVENTION

This invention relates to a device for forming single selvedges, particularly useful in continuous feed shuttleless looms, and double selvedges when, on looms of large size, two or more fabric pieces are woven simultaneously.

In the prior art, various devices are known which are effective to cut and curl the weft yarn ends extending out of the shed, and substantially comprise mechanical or pneumatic-mechanical mechanisms the movements whereof are synchronized on the slay and which are adapted to first cut and then curl the cut end.

Such known devices have several drawbacks, among which: difficulty of adaptation for weaving different yarns and particularly hairy ones, the necessity for frequent cleaning of the shoe retaining the cut yarn, the rather low processing speed limit due to the presence of spring biassed negative cams, frequent failure of the cam springs, noisy device operation, and difficulty of providing a continued and effective lubrication for the mechanism.

SUMMARY OF THE INVENTION

It is a primary object of this invention to provide a simple and reliable device which obviates or at least minimizes the cited drawbacks. More particularly, it is an object of this invention to provide a fully mechanical yarn cutting device which incorporates a complete means of adjustment, and makes no use of elastic biassing means which are likely to cause a critical and unreliable operation.

A further object is to provide the actuating and drive devices enclosed in a sealed housing or casing, such as to ensure improved lubrication and noise level characteristics.

It is another object of the invention to provide a dual device for location at an intermediate point of the loom length, thereby two or more fabric pieces with selvedges may be obtained with a single weaving pass.

A not unimportant object is to provide a device of simple design and reduced maintenance, and accordingly also convenient from an economical standpoint.

These and other objects, such as will be apparent hereinafter, are achieved by a device for forming at least one selvedge, characterized in that it comprises a scissors type of cutting unit, a retaining shoe for each selvedge, a pick up hook for each retaining shoe adapted to bring the cut yarn back into the weft shed, positive cam actuators and linkages operative to sequentially control the yarn cutting and picking up operations, a sealed casing containing said actuators and linkages, and independent adjusting and positioning means for said cutting unit and for the temple cover and support.

BRIEF DESCRIPTION OF THE DRAWINGS

Further features and advantages of the device according to this invention will be readily understood from the following detailed description of two preferred, though not restrictive, embodiments thereof, given herein by way of example and not of limitation, and illustrated in the accompanying drawings, where.

DESCRIPTION OF THE PREFERRED EMBODIMENTS

Figure 1:
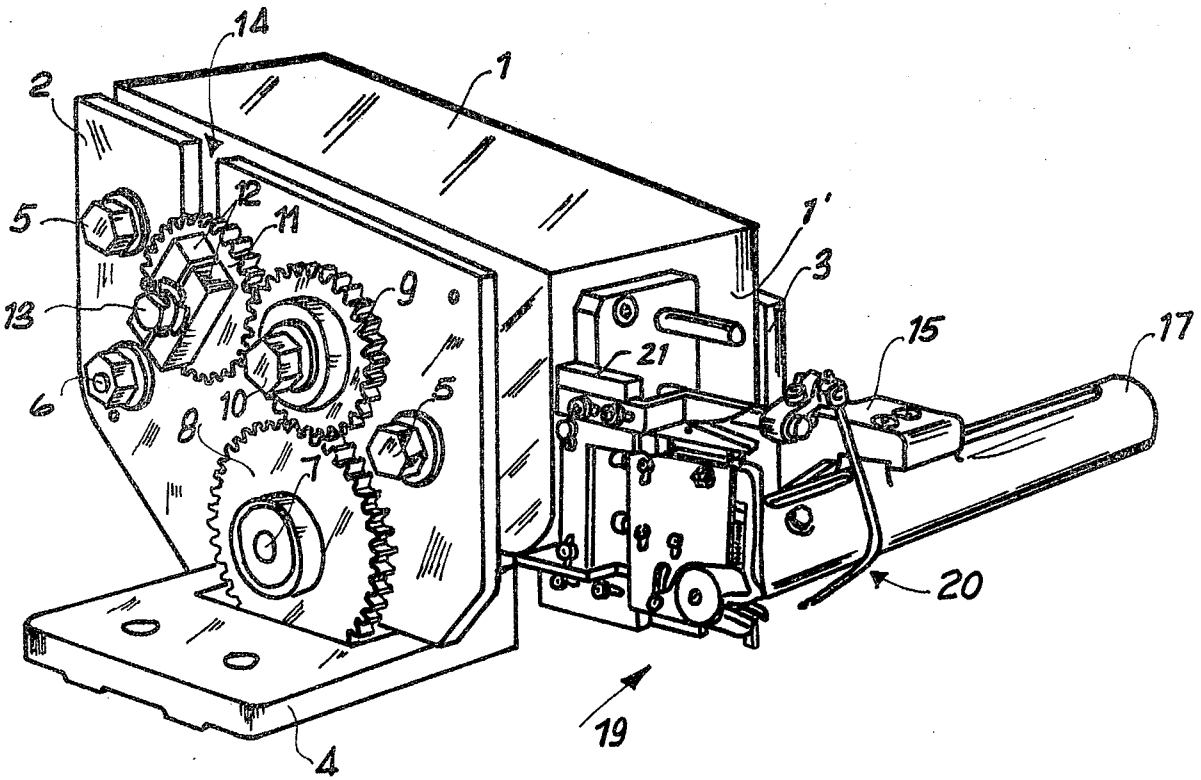
FIG. 1 is an overall perspective view of a first embodiment of the instant device, as adapted for a selvedge on the side opposite to the yarn feed.

With reference to the cited figures, the instant device comprise an actuating box or casing 1 inserted between two vertical wings 2 and 3, parallel to each other, the former whereof belongs to an inverted-"T" bracket, a horizontal portion 4 whereof is fixed on the loom breast beam in a rigid manner by means not shown. The latter wing, 3, belongs instead to an "L" bracket, the horizontal portion whereof engages with the horizontal portion of said inverted "T" bracket by means of adjustable screws received in slotted holes allowing it to be shifted along a line extending normal to the weaving direction, while said inverted "T" horizontal portion is held stationary.

Said box or casing 1 is attached to said vertical wings 2 and 3 by means of through bolts 5, also received in slots, their loosening being effective to provide, by means of a tappet 6, a displacement of said box 1 relative to said wings 2 and 3, along a normal axis to the weaving direction.

To said vertical wing 2, externally with respect to said box or casing 1, is journaled a driving gear 8 carrying fixed shaft 7, the gear 8 deriving its motion from a pinion gear provided in the breast beam and not shown.

The kinematic train further includes a jockey 9 with shaft 10 which for the purpose of displacement of the casing 1 is adjustable along an arc of a circle centered on said fixed shaft 7, and a driven gear 11 associated, through clamping means 12, to a splined shaft 13 rotating inside said casing 1. To allow said casing 1 to be withdrawn from the wings 2 and 3 of said inverted "T" bracket, a notch 14 is provided for the passage of said splined shaft 13 with an upward movement.

To the other vertical wing 3, there is journaled — as more clearly visible in the second embodiment of the invention — an arm 15 for rotation about a pin 16 associated with said vertical wing 3 and adapted to support the cover of the temple 17, the position whereof with respect to the temple being pre-determined and maintained by tightening a locking screw 18.

To the front of said casing or box 1, i.e. to the weaving side thereof, there is associated a jutting scissors type of cutting unit 19 and the yarn pick up hook 20.

Said cutting unit or device 19 substantially consists of three parts, namely: a support 21, a vertical plate 22 only enabled to reciprocate with a horizontal translatory movement, a C-like member 23 which is movable for translation-rotation being associated with the yarn retaining shoe 24. As visible in FIG. 1, the support 21 is fixed on the front wall 1' of the casing 1. As best visible in FIG. 3, the C-like member 23 has an upper leg 23′ a lower leg 23″ and a web 23‴ connecting the legs 23′ and 23″.

More specifically, the vertical plate 22 has a nearly flat rectangular configuration and is associated, on the casing side, to two pistons 25 which are movable horizontally of reciprocating motion. Said plate 22 has at its front bottom portion a fixed blade 26 provided with a cutting edge, and the C-like member 23 is journaled thereto at 27, its rotation being allowed within limits by two arcuate slots, a lower one 28 and upper one 29, and having their centers concentrical with said pin 27, wherein there are movable, in the lower one 28 a movable pin 30 associated with said C-like member 23, and in the upper one 29 a fixed pin 31 associated with said plate 22. The two slots are respectively formed in the C-like member 23, the upper one 29, and in the plate 22, the lower one 28.

Said C-like member 23 is associated, by means of said pin 30 passing through said slot 28, with a movable blade 32 located on the opposite side with respect to the plate 22, and is journaled on the same pin 27. Said C-like member further includes at its bottom a jutting cylindrical finger 33 the translatory movement whereof is limited by a flat cam 14 having travel limit stop arms indicated with two vertical lines 35 in FIG. 3, only one limit stop arm 34 being visible in FIG. 2.

Said yarn retaining shoe 24 is supported by a shaft 36 passing through two vertical bores formed in the thickness of the horizontal legs 23′ and 23″ of said C-like member 23, and guided therein. When the shoe 24 is in its upper most position it exerts pressure onto a bearing shoulder 37 thereby to grip a yarn located therebetween, as will be described later. The shape of said shoulder 37 approximately mates said movable blade 32 when the latter is in its open position. The gripping action of said shoe 24 is provided by a spring 38 acting between the inner face of the lower arm 23′ of said C-like member 23 and a stop 39 rigid with said shaft 36 and slidable along a fixed vertical parallel cylindrical rod 40 such as to prevent the shaft 36 and the shoe 24 from rotating about the axis of shaft 36.

Said shoe is maintained in its open position through the action on its shaft 36 extending beyond the top of said C-like member 23, of a virtually horizontal lever 41, journaled to a vertical projection 42 of the upper arm 23′ of said C-like member 23, at the inner end portion thereof. The lever 41 is actuated by engagement with a fixed guide or cam 43 formed on said support 21.

Said lever 41 is made of U-bent sheet metal providing a cavity between the legs of the U-shape. It is constantly urged upwards at the opposite end with respect to said pivot point by a cylindrical coil spring 44 acting on the legs of the U-shape forming the side walls of lever 41 as visible in FIG. 3. The spring 44 is guided by the projecting portion of said cylindrical rod 40, said projecting portion being inserted through the said cavity of the lever 41.

Under said push force, a roller 45 journaled at a nearly central position with respect to said lever 41 follows said fixed guide 43 irrespective of whether the movement of the C-like member 23 is a translatory or rotary one, eventually disengaging itself therefrom in its position of maximum forward advance.

Said lever 41 engages at its front portion — opposite the pivot point — with the upper portion 46 of said shaft 36, and in its movement as determined by said fixed guide 43, controls the movement of the shoe 24.

At the pivot area of said lever 41, there is provided an adjustment 47 for the degree of opening of said lever 41, the adjustment 47 comprising a set screw and locking nut.

Figures 4, 4A:
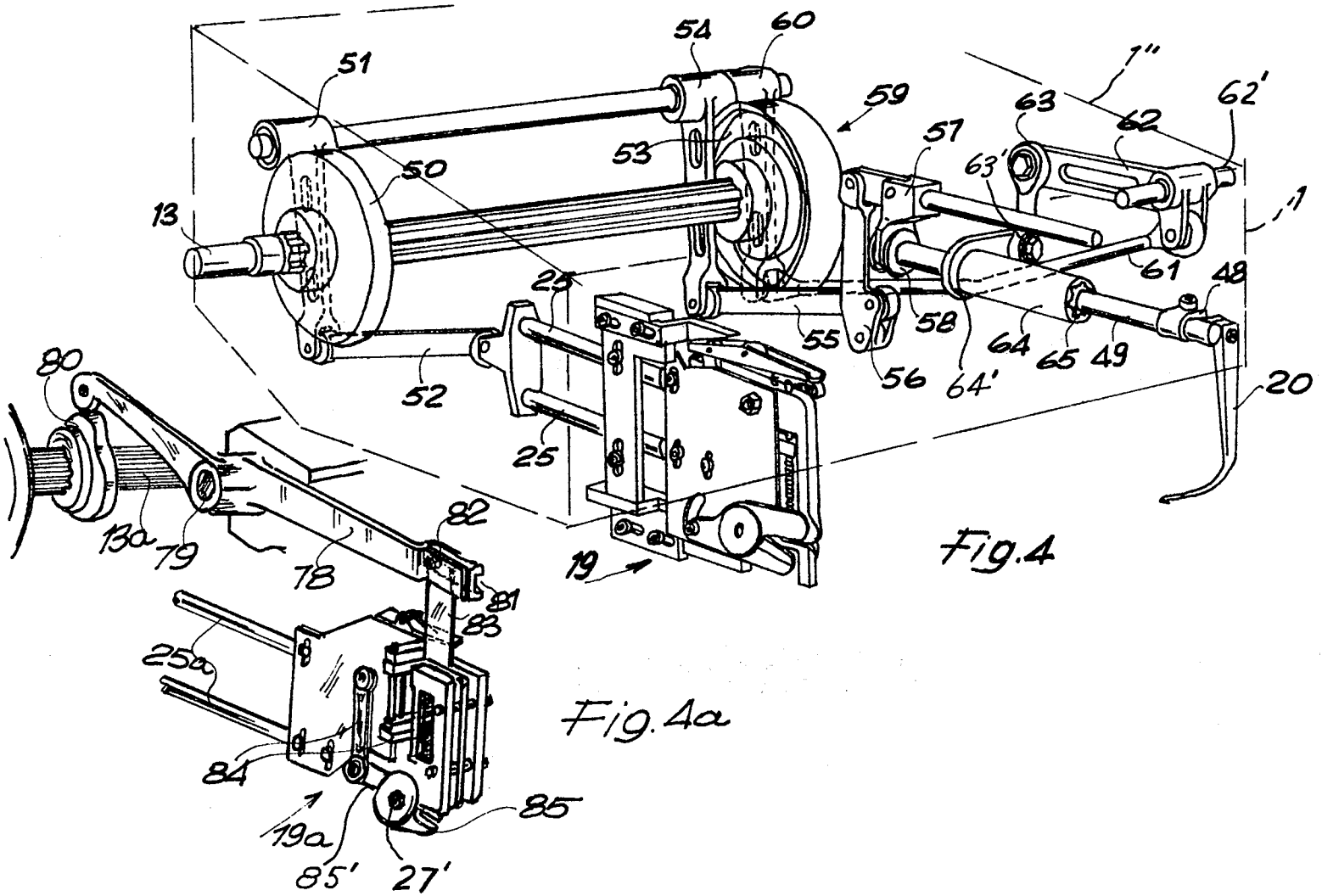
FIG. 4 illustrates the drive mechanism.
FIG. 4A shows a variation to the drive mechanism.

FIG. 4A shows a variation to the actuating device for the cutting unit indicated here at 19A.

Figure 3:
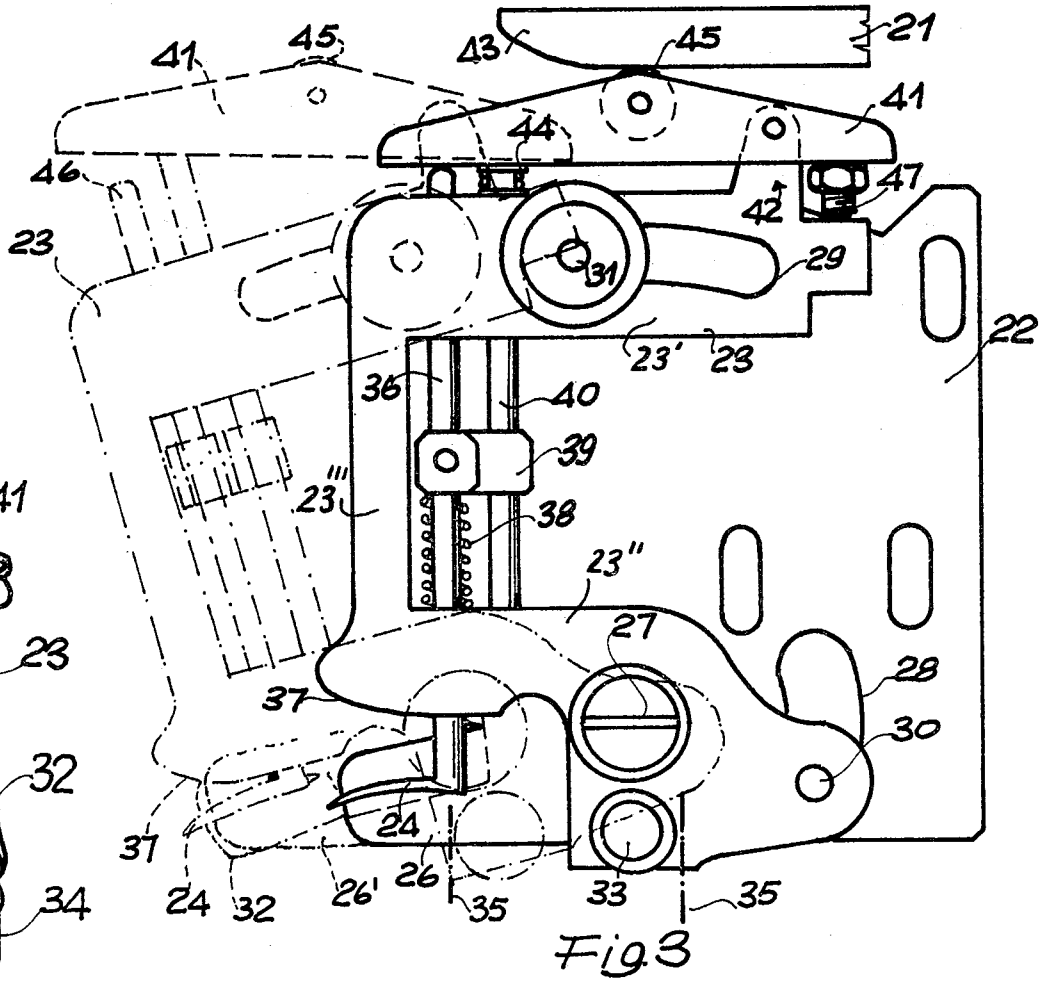
FIG. 3 shows in full lines the cutting unit of FIG. 2 in its open position, and in dotted lines the same unit in its closed position.

In this embodiment, the forward movement of the unit is still carried out through two pistons 25A reciprocating in a horizontal direction, whereas the fixed guide 43 is replaced by a linkage 78 which, being journaled at 79 to the device frame, is actuated on one side by a negative cam 80 engaging said splined shaft, indicated here at 13A, and on the other side engages through a rectilinear seat 81 provided thereon, with a pin 82 projecting from a vertical rod or bar 83 constituting an extension of the through shaft 36 carrying the yarn retaining shoe 24 (the latter elements 36 and 24 being referred to FIG. 3 for similarity reasons).

With the same movement, the vertical bar 83 operates, through a linkage 84, the movable cutting blade 85 as well.

Like in the embodiment of FIG. 3, the body of the movable cutting blade 85 is journaled on a pin 27′ and on the lever-like end 85′ of the cutting blade body the linkage 84 is articulated to oscillate the cutting blade body about the pin 27′ when the bar 83 is reciprocated in syinchronism therewith upon the action of linkage 78.

Side by side to said cutting device 19, and located on the side of said yarn retaining shoe 24, there is said pick up hook 20 which receives support, by means of clamping or locking devices 48 known per se, from a horizontal drive shaft 49 projecting out of the front plate of said box or housing 1.

Said box or housing 1 contains the actuating devices, namely three discrete kinematic trains: the first train comprises a first positive cam 50 keyed to said splined shaft 13 which is followed by a first lever with cam follower 51 which is linked with a first connecting rod 52, which in turn is associated with said movable pistons 25.

The resulting motion of said pistons is merely translatory-reciprocating.

The second kinematic train has the function of providing a horizontal translatory reciprocation of the drive shaft 49 for said pick up hook 20 and consists of a second positive face cam 53 keyed to said splined shaft 13, being followed by a second lever and follower 54 which, through linkages 55 and 56, actuates the horizontal translatory movement of a yoke 57 in engagement with a groove 58 in the inner end portion of said drive shaft 49.

As visible in FIG. 4 the groove 58 is similar to a circumferential pulley groove on which the yoke 57 rides. Such groove is similar to grooves 73, 74 shown in FIG. 6.

Thus the shaft 49 is caused to reciprocate without impeding its independent rotary motion.

The third kinematic train has the function of rotating said shaft 49 and comprises a third positive or face cam 59 formed in the body of said second cam 53 on the opposite side thereto, and followed by a third lever and follower 60 which, through connecting rods and levers 61,62,63, actuates for rotation an internally splined sleeve 64 engaging with a matingly splined area 65 at the middle portion of said shaft 49. In fact, as visible in FIG. 4, the linkages 61, 62, 63 lie in a plane offset to the axis of shaft 49 and are oscillatable about a fixed pin 62′ journaled on a side wall 1'' of the casing 1. The lower end 63' of the lever 63 is linked to a bracket 64', which transmits the oscillating movement to the splined sleeve 64 to which it is fixed so that the later oscillates together with the shaft 49 about the axis thereof.

Figure 5:
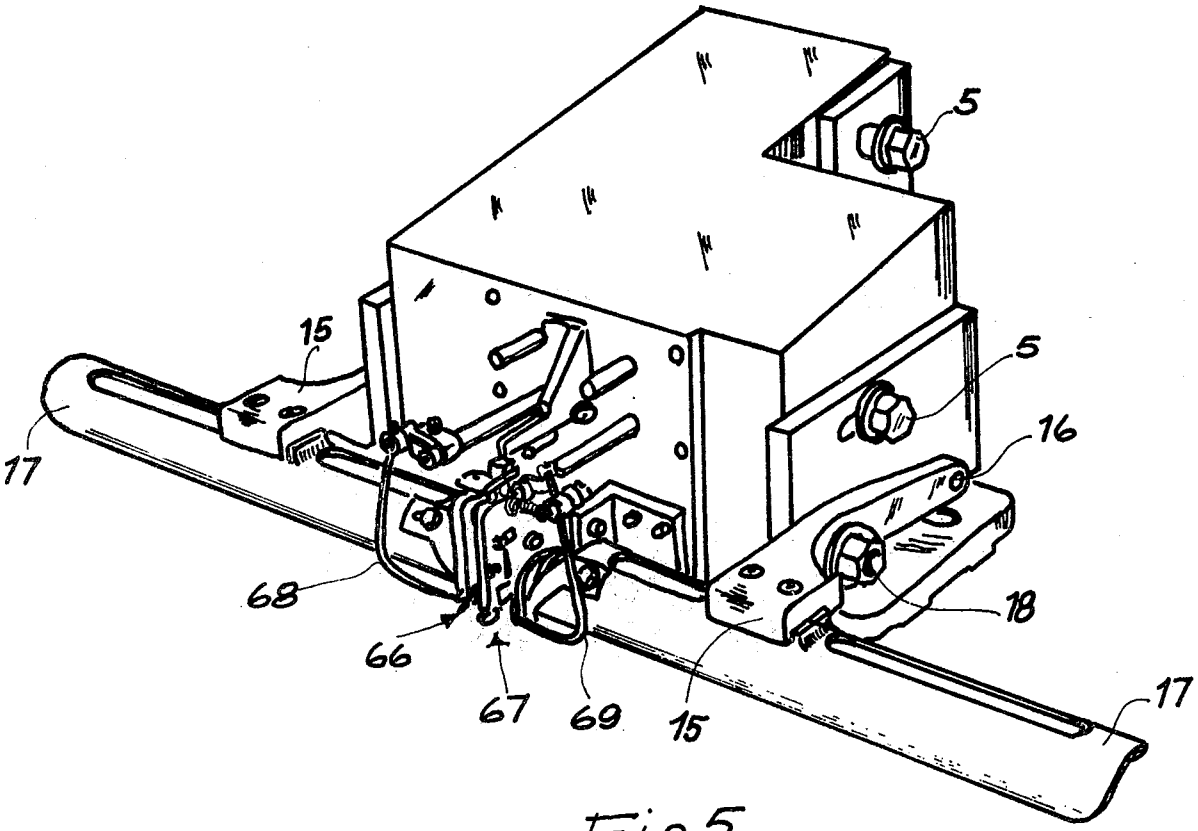
FIG. 5 is an overall perspective view of a second embodiment, as adapted for an intermediate double selvedge for separating laps.

In a second embodiment of the invention, shown in FIG. 5, there is provided a device for double selvedge forming, again comprising a single scissors-like cutting member but having two retaining shoes 66,67, and accordingly two bearing shoulders similar to 37 above, which are actuated by a single lever similar to 41 above, but having a wider base. All the other components remain the same, or re-arranged mirror-like with respect to the cutting member.

As regards the actuation of the cutting unit, no variations are provided, excepting that the C-like member 23 is partly doubled along its front portion to support the second shoe and moves the two shoes concurrently at the same time.

Figure 6:
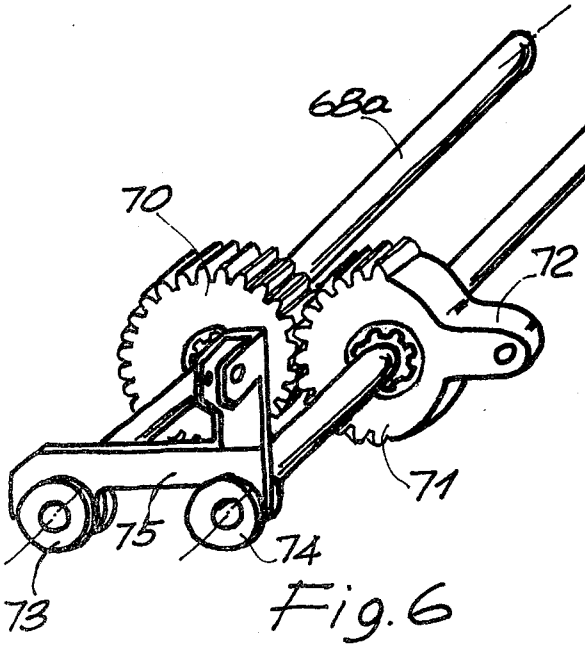
FIG. 6 shows the mechanism actuating the movements of the pick up hooks.

As regards the two symmetrical pick up hooks, indicated at 68 and 69 in FIG. 5, they are actuated by a device depicted in a first form in FIG. 6; in this instance, the two splined shafts 68*a* and 69*a* slide through two gears 70 and 71 which are keyed to splined sleeves mating said splined shafts.

The two gears 70 and 71 mesh together, and the one indicated at 71 is only toothed along an arc of about 180° and has, at its smooth portion, a lug 72 whereon is active the train of actuating linkages for its rotary motion.

At their two inner heads, the two shafts 68*a* and 69*a* are provided with two grooves, 73 and 74 respectively, similar each to a circumferential pulley groove, whereon rides a double yoke 75 connected to the kinematic train which actuates the reciprocating motion of forward advance.

Figure 7:
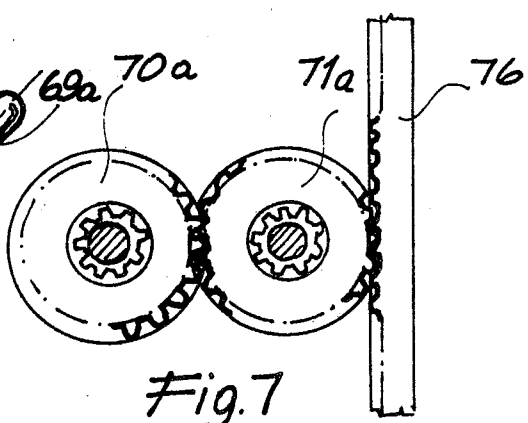
FIGS. 7 and 8 show two variations to the mechanism of FIG. 6.
Figure 8:
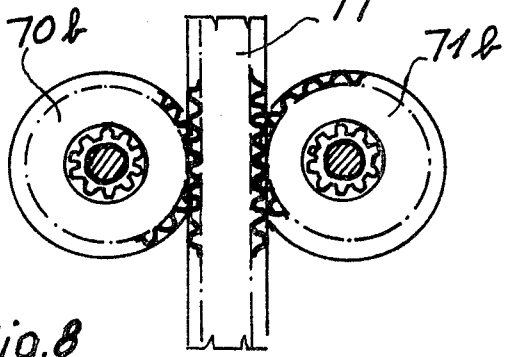

The rotary movement may also be obtained through a side rack 76 acting on one of the two gears 70*a* and 71*a*, here toothed throughout as shown in FIG. 7, or through a dual central rack 77 acting on both gears 70*b* and 71*b* in a simultaneous manner.

Figure 2:
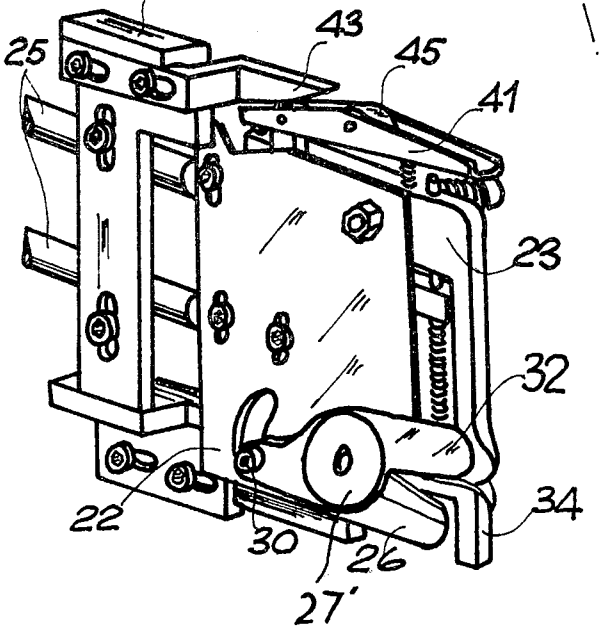
FIG. 2 is a perspective view of a cutting unit.

Both in the single selvedge and double selvedge devices, the movement sequence is the following: when the entrained yarn is between the two blades, the C-like member moves forward with a translatory motion transmitted thereto through the pin 27 by the plate 22 actuated by the pistons 25 (FIGS. 2, 3). When the finger 33 of the C-like member 23 strikes against the forward limit stop arm of the cam 34 the C-like member 23 partly rotates (dotted lines in FIG. 3) to actuate first the retaining shoe by allowing the rod 36 to be shifted upwards by the spring 38 in view of the inclined position of the C-like member 23. Then upon further rotation of the C-like member 23 the movable cutting blade rigid therewith cuts the yarn. At this point, the yarn is caught by the pick up hook, released from the shoe, and brought back into the weft shed or tucked therein to form the selvedge. The operation of the dual tucking hooks 68, 69 is per se known and is similar to that disclosed in U.S. Pat. No. 3,111,966.

The peculiarities of the described device are plural and such as to achieve the invention objects: in fact, the provision for positive cams achieves the object of maximum operational reliability, even at high speeds, with no breaking risk for the springs, now omitted.

As concerns the shafts projecting out of said box or casing, they all undergo a translatory or roto-translatory motion, and their thru-casing seats are sealed, lubricant oil being retained within the casing or box. Thus the device is enabled to operate more satisfactorily, with less wear and noise.

With the double intermediate selvedge, a double selvedge is produced, or in other terms two finished fabric bolts in one weaving pass.

From this same inventive principle, other embodiments may originate, which have been discussed only partially and fall within the scope of this application.

In particular, the materials and dimensions used may be any ones to suit individual requirements.

I claim:

1. A device for forming at least one selvedge, comprising a scissors type of cutting unit for cutting a yarn, at least one yarn retaining shoe for each selvedge, at least one pick up hook for each retaining shoe adapted to bring an end portion of the cut yarn back into the weft shed, positive cam actuators and linkages operative to sequentially control the yarn cutting and picking up operations, a sealed casing containing said actuators and linkages, and independent adjusting and positioning means for said cutting unit and for the temple cover and support, wherein according to the improvement said cutting unit comprises a vertical plate, a fixed blade at the front bottom portion of said plate, two pistons movable horizontally with translatory motion, and connected with said plate, a kinematic train imparting said translatory motion, said kinematic train comprising a cam cooperating with a lever and connecting rod, a C-like member journaled to said plate in a point thereof and having a cutting blade movable therewith with scissors-like movements and a jutting finger at a distance from said point, a flat cam having limit stop arms controlling said motion and acting as travel limiter for the translatory motion of said C-like member, whereon said jutting finger abuts during said translatory motion to cause a cutting rotary movement of said C-like member.

2. A device according to claim 1, characterized in that said C-like member has a shoulder cooperating with said shoe effective to retain the cut yarn until the latter is caught by said pick up hook, said shoe comprising a movable normally vertical shaft supporting said shoe, a lever actuating said movable normally vertical shaft and a fixed cam controlling the position of said lever during movement of said C-like member.

3. A device according to claim 1, characterized in that said positive cam actuators and linkages include, for two said pick up hooks, supporting shafts for said pick-up hooks, peripheral grooves formed on each inner end of said supporting shafts, splined sleeves on said shafts, a dual yoke simultaneously engaging said two grooves, said yoke being connected with said kinematic train imparting said translatory reciprocating motion to said pick up hooks; two gears, each gear being keyed to one of said splined sleeve, said gears meshing together and one of said gears having means adapted to be connected to the kinematic train imparting to said gears and accordingly to said pick up hooks a reciprocating rotary motion.

4. A device according to claim 3, characterized in that said gears operative to impart said reciprocating rotary motion to said pick up hooks are in mutual mesh, and wherein said means providing connection with said kinematic train comprise a rack in mesh with one of said gears, said rack being connected for receiving a reciprocating translatory motion from said kinematic train.

5. A device according to claim 3, characterized in that said means providing connection with said kinematic train comprise, between said gears operative to impart said reciprocating rotary motion to said pick up hooks, a dual central rack in mesh engagement with both gears and driven for reciprocating translatory motion from said kinematic train.

* * * * *